US006512483B1

(12) United States Patent
Holden et al.

(10) Patent No.: US 6,512,483 B1
(45) Date of Patent: Jan. 28, 2003

(54) ANTENNA ARRANGEMENTS

(75) Inventors: Anthony J Holden, Brackley (GB); Michael C Wiltshire, High Wycombe (GB); David J Robbins, Towcester (GB); William J Stewart, Blakesley (GB); John B Pendry, Cobham (GB)

(73) Assignee: Marconi Caswell Limited, London (GB)

( * ) Notice: Subject to any disclaimer, the term of this patent is extended or adjusted under 35 U.S.C. 154(b) by 0 days.

(21) Appl. No.: 09/623,101

(22) PCT Filed: Dec. 23, 1999

(86) PCT No.: PCT/GB99/04406

§ 371 (c)(1),
(2), (4) Date: Nov. 3, 2000

(87) PCT Pub. No.: WO00/41269

PCT Pub. Date: Jul. 13, 2000

(30) Foreign Application Priority Data

Jan. 4, 1999 (GB) ..... 9900033

(51) Int. Cl.[7] ..... H01Q 1/26
(52) U.S. Cl. ..... 343/701; 343/910; 343/911 R
(58) Field of Search ..... 343/701, 785, 343/700 MS, 910, 911 R

(56) References Cited

U.S. PATENT DOCUMENTS 4,169,268 A 9/1979 Schell et al.
5,162,809 A 11/1992 Wu
5,406,573 A 4/1995 Ozbay et al.
5,793,505 A * 8/1998 Shurtz, II et al. ..... 359/885
5,864,322 A * 1/1999 Pollon et al. ..... 343/909
5,963,169 A * 10/1999 Anderson et al. ..... 343/701

FOREIGN PATENT DOCUMENTS

WO WO 96/29621 9/1996
WO WO 99/23719 5/1999

OTHER PUBLICATIONS

*High frequency properties of glass–coated microwire*, A. N. Antonenko, et al., Advanced Metal Technologies Ltd., Israel, Journal of Applied Physics, vol. 83, No. 11, Jun. 1998, pp. 6587–6589.

*Low frequency plasmons in thin–wire structures*, J. B. Pendry, et al., The Blackett Laboratory, United Kingdom, Mar. 20, 1998, pp. 47854809.

* cited by examiner

*Primary Examiner*—Don Wong
*Assistant Examiner*—Shih-Chao Chen
(74) *Attorney, Agent, or Firm*—Kirschstein, et al.

(57) ABSTRACT

The performance of a microwave antenna is improved by incorporating a fine wire dielectric material which has a dielectric constant ∈ of less than unity at microwave frequencies. The effect of the dielectric material is to refract microwaves so that the antenna appears to have a larger aperture than that of its physical size. Furthermore, by selecting the transmission cut off frequency of the dielectric material, two antenna elements which are intended to operate within different frequency bands can be mounted one behind the other.

8 Claims, 3 Drawing Sheets

ANTENNA ARRANGEMENTS

BACKGROUND OF THE INVENTION

This invention relates to an antenna arrangement, and is particularly concerned with microwave antenna arrangements.

SUMMARY OF THE INVENTION

According to this invention, a microwave antenna arrangement comprises a microwave antenna structure characterized by a fine wire dielectric positioned in front of said microwave antenna structure so that microwaves transmitted or received by said antenna structure pass through said dielectric, which has a dielectric constant of less than unity at microwave frequencies and a plasma frequency below that of said microwaves.

By a fine wire dielectric it is meant an array of thin elongate electrical conductors which exhibits a dielectric constant of less than unity below a plasma frequency. It has been shown that a fine wire dielectric behaves like a low density plasma of very heavy charged particles with a plasma frequency in the GHz range, see "Low frequency plasmons in thin-wire structures" by J. B. Pendry, A. J. Holden, D. J. Robbins and W. J. Stewart, J Phys: Condensed Matter 10 (1998) 4785–4809.

The combination of the fine wire dielectric and the antenna structure enables the operation and performance of the antenna to be modified in various ways. By arranging that the dielectric constant is between zero and unity over the operational frequency band of the antenna structure, the apparent size or aperture of a radiating or receiving antenna element is increased, thereby permitting a physically narrower radiation beam to be produced resulting in an enhanced performance.

The fine wire dielectric may take various forms. For ease of manufacture, it is preferred that it consists of a plurality of spaced apart planes, with parallel fine wires lying in each plane, and with the direction of the wires alternating by 90° for successive planes. Alternatively, the fine wires can comprise a mesh in which two sets of parallel wires lie in a common plane so as to interconnect at their crossing points, and furthermore the fine wire dielectric can take the form of a three-dimensional structure, by providing an array of wires at right angles to the planes of these two sets, thereby forming a three-dimensional lattice. Instead, the dielectric can comprise short individual wires at right angles to the plane of the dielectric, so that it has a "hairbrush" like structure.

The use of the invention permits an antenna arrangement to be constructed in which antenna structures having different operational frequencies physically overlap. For example, an outer, lower frequency antenna structure can be transmissive of higher frequencies received or transmitted by a high frequency antenna mounted behind it. In this case, the dielectric constant is arranged to have a negative value in the low frequency band, so that the dielectric is non-transmissive of the lower frequencies.

BRIEF DESCRIPTION OF THE DRAWINGS

The invention is further described by way of example with reference to the accompanying drawings, in which.

DETAILED DESCRIPTION OF THE PREFERRED EMBODIMENTS

Figure 1:
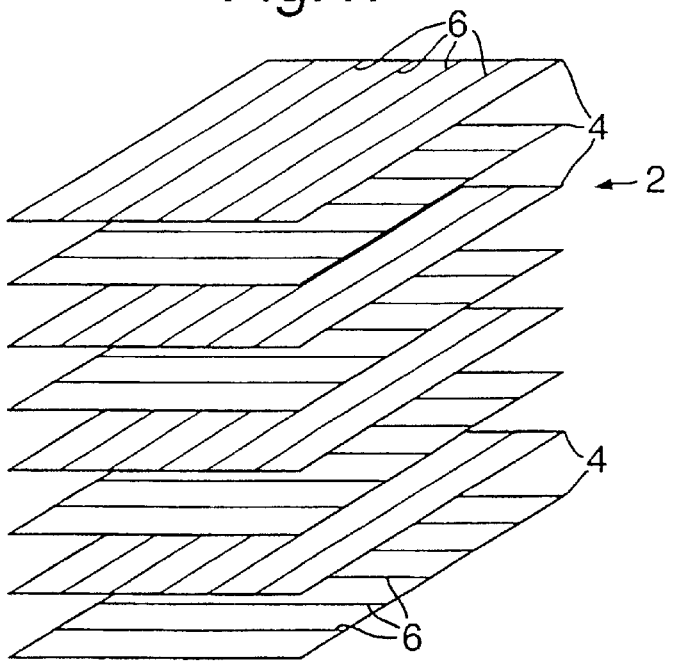
FIG. 1 is a schematic representation of a dielectric structure capable of exhibiting a negative dielectric constant.

Referring to FIG. 1, there is shown a schematic representation of a two-dimensional fine wire dielectric structure (hereinafter referred to as a structured dielectric material) 2 which comprises a plurality of stacked sheets 4 of polystyrene. On each sheet 4 there are provided parallel rows of thirty micron diameter gold plated tungsten (Au—W) wires 6 which have a 5 mm spacing between rows. The sheets 4 are stacked such that in alternate sheets the wires 6 run in directions which are at right angles to one another. This results in the structure 2 exhibiting dielectric behavior.

In this example, the size of each sheet 4 is 200 mm by 200 mm, the spacing between sheets is 6 mm and the overall thickness of the structure, that is in the direction denoted z in FIG. 1, is 120 mm.

It is important that the wires 6 are thin (fine), of the order of a few tens of microns in diameter, and that the spacing between the wires 6 within a sheet 4 is small compared with the wavelength of the radiation with which the structured dielectric material 2 is intended to be used. Such a structure behaves as a microstructured dielectric that exhibits metallic properties, but whose plasma frequency $\omega_p$ is not in the ultraviolet but in the microwave, that is GHz, region. As is known the plasma frequency $\omega_p$ of a material is the frequency at which the dielectric constant of the material is zero.

A simple picture of the plasma frequency can be obtained by considering a metal which is composed of positive ions surrounded by a weakly bound 'gas' of electrons which are free to move. In the absence of an electric field the system is electrically neutral. When an external electric field is applied this causes the electron gas to drift until it is stopped by the opposing electric field between the now displaced negative electrons and the positive ions. If a low frequency ac field is applied the electron gas can respond, oscillating back and forth in phase with the field; the system behaves like a driven harmonic oscillator. As such, it has a resonant frequency or natural frequency of oscillation which is called the plasma frequency $\omega_p$. At frequencies above the plasma frequency $\omega_p$, the electrons can no longer respond quickly enough to the applied field and the dielectric constant saturates at a background value associated with the charge on the ions. In typical metals the plasma frequency $\omega_p$ is in the ultraviolet region.

It has been established by comparison with direct solution of Maxwell's equations in periodic media and by comparison with measurement of a thick wire structure based on Au—W wires, that the plasma frequency $\omega_p$ in a thin wire grid is given quite accurately by treating the self inductance of the wire as an additional contribution to the electron effective mass m* through the relationship:

$$m^* = \frac{\mu_0 e^2 n \ln(a/r)}{2\pi} \quad \text{Equ. (1)}$$

where r is the radius of the wires, a their separation, e the electronic charge, n the electron density and ln is the natural logarithm. The plasma frequency $\omega_p$ is given by:

$$\omega_p = \sqrt{\frac{ne^2}{\varepsilon m^*}} \quad \text{Equ. (2)}$$

where $\in$ is the dielectric constant. Substituting Equ. (1) into Equ. (2) gives:

$$\omega_p = \sqrt{\frac{2\pi c^2}{a^2 \ln(a/r)}} \quad \text{Equ. (3)}$$

The dielectric function $\in(\omega)$, that is the variation of dielectric constant with frequency, for the dielectric structure is the same as that of a conventional metal and is given by the relationship:

$$\varepsilon(\omega) = 1 - \frac{\omega_p^2}{\omega(\omega + i\gamma)} \quad \text{Equ. (4)}$$

where $\gamma$ is the damping due to the resistance of the wire and $i=\sqrt{-1}$.

Figure 2:
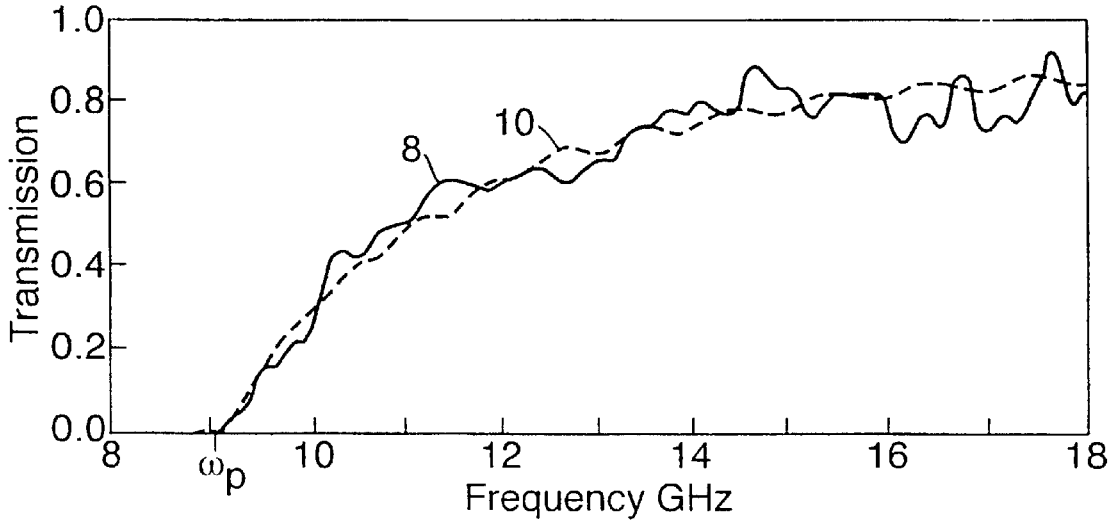
FIG. 2 is a plot of transmission versus frequency for the dielectric structure of FIG. 1.

The transmission properties of the dielectric structured material 2 of FIG. 1 as a function of frequency are shown in FIG. 2. As can be seen from this figure the plasma frequency $\omega_p$ for the structure is 9.2 GHz. Below this frequency, the dielectric constant is negative and the structure does not transmit. Above this frequency the dielectric constant is positive, and increases towards unity with increasing frequency such that the structure substantially transmits without substantial attenuation. In FIG. 2 the measured response is shown by the solid line denoted 8 and the calculated response shown by a broken line 10. As will be apparent from the Figure the measured and calculated responses are in good agreement.

Figure 3:
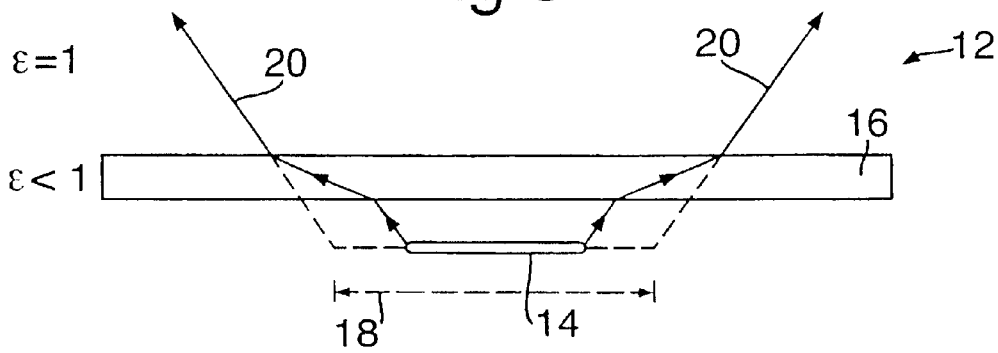
FIG. 3 is a schematic representation of an antenna arrangement according to a first embodiment of the invention.

Referring to FIG. 3, there is shown an antenna arrangement 12 in accordance with a first embodiment of the invention for operation at microwave frequencies. The microwave antenna arrangement 12 comprises a microwave antenna structure 14, such as for example an array of dipole elements, which is mounted behind a fine wire dielectric structure 16 such as that shown in FIG. 1. The structured dielectric material 16 is constructed such that its dielectric constant $\in$ is less than unity over the operating frequency band of the antenna structure 14: the dielectric constant of the air being unity. The antenna structure 14 has a certain physical size as illustrated, but the effect of the structured dielectric material 16 is to increase the antenna aperture as represented by the double-headed arrow denoted 18 in FIG. 3.

Radiation 20 transmitted by the antenna structure 14 undergoes refraction at the structured dielectric material 16, thereby increasing the effective dimension or aperture of the microwave antenna structure 14.

A common problem with the performance of arrays of antennas that are designed to operate over a wide range of frequencies is that, at the lower frequencies, the angular spread of the beam of radiation is excessively great. The structured dielectric material of the present invention can be used in such a case to limit the angular extent of the beam of radiation that emerges from the antenna arrangement. In particular, if the structured dielectric material is configured such that its plasma frequency is designed to be below the lowest frequency of intended operation of the antenna structure, the structured dielectric material will act most strongly to restrict the angular spread of the lowest frequencies, and least strongly to restrict that of the higher frequencies. This results in a more uniform angular spread as a function of frequency.

Figure 4A:
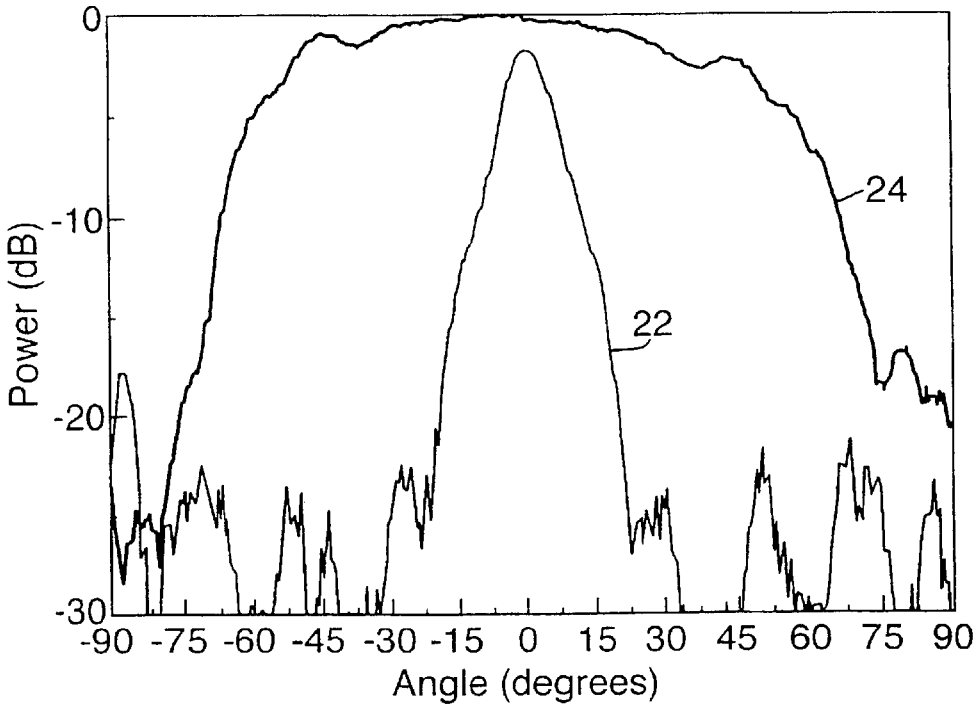
FIGS. 4(*a*) and 4(*b*) are plots of transmitted power versus angle for the antenna arrangement of FIG. 3 at frequencies of (a) 9.5 GHz and (b) 10.5 GHz respectively.
Figure 4B:
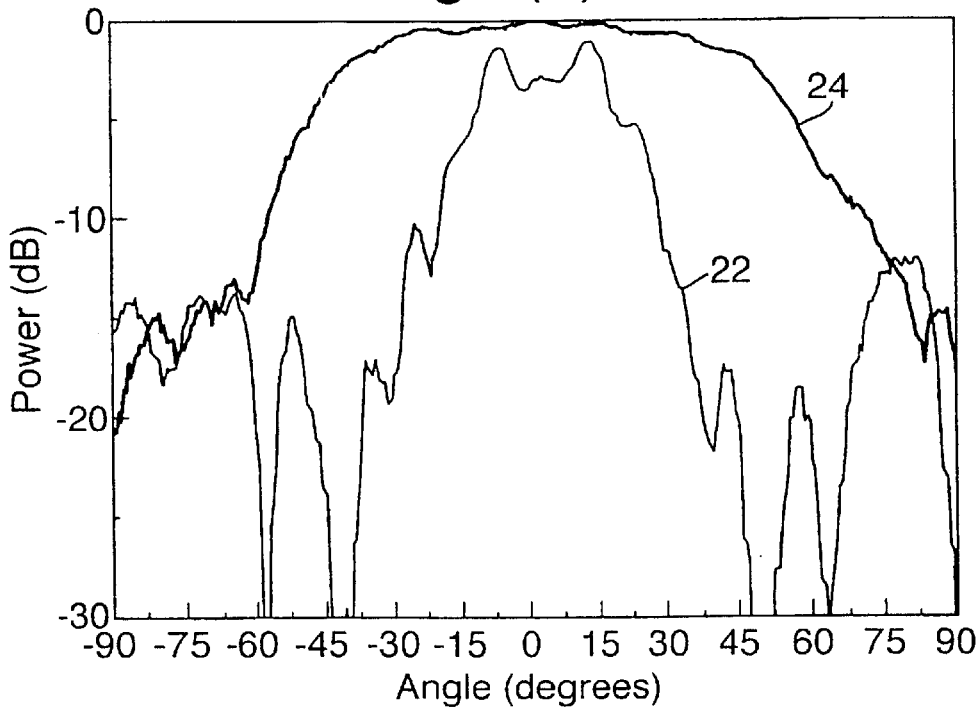

This effect is illustrated in FIGS. 4(*a*) and 4(*b*) which shows plots of transmitted power versus angle for the antenna arrangement 12 of FIG. 3 at a frequency of operation of (a) 9.5 GHz and (b) 10.5 GHz. In FIGS. 4(*a*) and 4(*b*) the antenna arrangement's performance with the inclusion of the structured dielectric material 16 is shown by the line 22 and that of the antenna structure 14 without the dielectric structure by the line 24. Comparison between the lines 22 and 24 thus indicates the effect of the inclusion of the structured dielectric material or filter 16.

Conventionally, to restrict the angular beam width requires a larger antenna; conversely, a larger antenna provides a more directional narrower beam. Placing the antenna structure 14 behind the structured dielectric material 16 increases the effective aperture of the antenna arrangement 12, since radiation leaving the antenna structure 14 at a finite angle to the normal of the structured dielectric material is refracted away from the normal and emerges on the far side of the structured dielectric material as if it had emanated from a larger source.

It will be appreciated that this effective enlargement of the antenna aperture also applies to the individual dipole elements of the antenna structure 14, which can be apparently enlarged so much that they appear to overlap as viewed from the front, that is the side of the structured dielectric material which is remote from the antenna structure. A feature of the dielectric structure transmission function is that an isotropic small source appears to become approximately Gaussian in shape under this process. The resulting overlapping Gaussian-form sub arrays represent an ideal antenna array with minimal sidelobes which cannot be realised in any other known way. It will be appreciated that radiation from the antenna structure 14 which strikes the structured dielectric material at an angle above a critical angle will be reflected. To prevent damage, or degradation of the performance of, the antenna structure by such unwanted reflected radiation it is preferred to embed the sources or elements of the antenna within the structured dielectric and/or to provide a microwave absorber on the back of the structured dielectric material or in the spaces between the elements of the antenna.

The effect of elements within the antenna arrangement appearing to overlap can be used to make antenna arrangements that do not physically overlap, but which appear to overlap when viewed from the far side of the structured dielectric material and so improve the performance of the antenna arrangement.

The structured dielectric material can be used to construct an extremely broad band composite antenna arrangement. The known broad band antennas (e.g. spiral antennas) are limited to a bandwidth of typically between one and two octaves. By using the structured dielectric material of the present invention in the construction of a broad band composite antenna arrangement, the bandwidth can be doubled.

Figure 5:
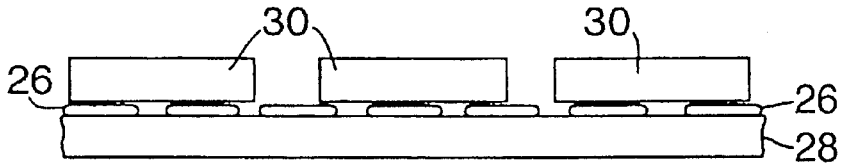
FIG. 5 is a schematic representation of a broad band antenna arrangement according to a second embodiment of the invention.

A broad band composite antenna arrangement in accordance with a second aspect of the invention is shown in FIG. 5 and comprises a conventional high frequency broad band antenna which is composed of an array of antenna elements 26 which are provided on a substrate 28. Overlaid on this frequency antenna is a second antenna, designed to operate at a lower frequency. The elements 30 of the lower frequency antenna are constructed from the segments of structured dielectric material whose plasma frequency is selected to lie at the overlap point of the low and high frequency antennas. As illustrated the lower frequency antenna comprises a plurality of antenna segments (of which only three are shown) which together constitute a phased array.

In operation the higher frequency antenna is driven in the usual way whilst the lower frequency antenna is driven via the conducting wires that comprise the structured dielectric material of each element 30. It will be appreciated that in this antenna arrangement, use is made both of the dielectric function of the structured dielectric material and the presence of the wires within the material which provide an electrically conducting path and which constitute the dipole elements of the lower frequency antenna structure. To improve the performance of the lower frequency antenna the patterning of the fine-wire within the structured dielectric material elements 30 is appropriately modified.

It should be noted that such a broad band antenna arrangement would not be possible using conventional thick-wire structures, as these would scatter and absorb the radiation. Fine wire structured materials according to the invention, on the other hand, appear uniform, with high transmission above the plasma frequency.

Figure 6:
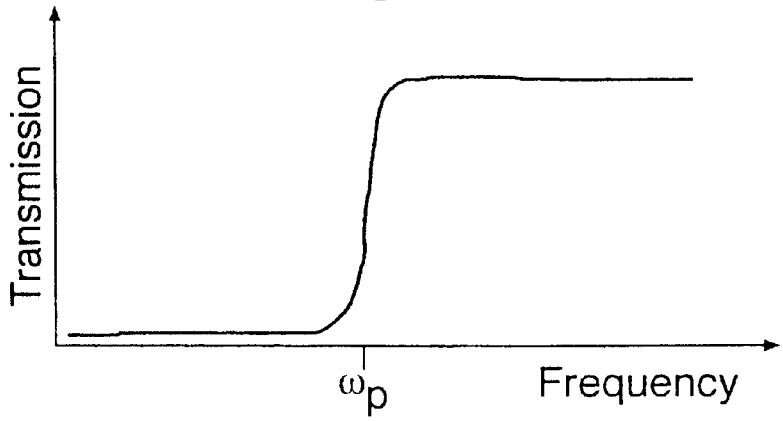
FIG. 6 is a plot of transmission versus frequency for the low frequency antenna of FIG. 5.

Referring to FIG. 6 this illustrates the transmission characteristic of the lower frequency antenna of FIG. 5. Thus, at low frequencies, below the plasma frequency $\omega_p$ the elements of the antenna are non-transmissive and so no contribution from the high frequency antenna is radiated in that band. The high frequency antenna operates at frequencies above the plasma frequency, and in this band the elements of the lower frequency antenna are transmissive allowing the radiated energy to pass substantially unattenuated.

In any embodiment of the invention the structured dielectric material can be constructed from a woven or knitted mesh of conducting wires. In particular, knitted copper mesh, conventionally used for electrostatic screening applications, can be used. This mesh is made from wires that are typically 50 $\mu$m thick. This is too thick for the present purpose, but it can be used to fabricate the structured dielectric material by etching the copper mesh until the wires are typically 20–30 $\mu$m thick. This etched mesh can then be laminated onto a microwave transparent foam of the requisite thickness, typically 2 mm, and these laminates assembled into the desired thickness of material.

An alternative approach to achieve the required thickness of the copper wires is to use glass coated amorphous microwires as described by A. N. Antonenko, E. Sorkine, A. Rubshtein, V. S. Larin and V. Manov in "High Frequency Properties of Glass-Coated Microwire" J. Appl. Phys. (1998) 83, 6587–9. This process can be used to provide a conducting wire of less than 30 $\mu$m thickness which, by virtue of the glass coating, is mechanically strong enough to survive a weaving or knitting process.

The wires in the mesh can be coated with a non-linear magnetic material, such as a ferrite. By changing the permeability of the coating, either by external means (such as the application of a dc magnetic field) or by the effect of incident electromagnetic radiation, the plasma frequency of the structured dielectric material can be changed. By this means, a switchable or controllable edge frequency can be achieved that could have application as a radiofrequency limiter, for example.

What is claimed is:

1. A microwave antenna arrangement, comprising: a microwave antenna structure including a fine wire dielectric positioned in front of said microwave antenna structure so that microwaves transmitted or received by said microwave antenna structure pass through said dielectric, said dielectric having a dielectric constant of less than unity at microwave frequencies and a plasma frequency below that of said microwaves, said dielectric including a low frequency antenna structure operative at lower frequencies than said microwave antenna structure, and the plasma frequency of said dielectric being arranged to be between the operative frequencies of said microwave antenna structure and said low frequency antenna structure.

2. The antenna arrangement of claim 1, wherein said dielectric has wires coated with a non-linear magnetic material.

3. A microwave antenna arrangement, comprising: a microwave antenna structure including a fine wire dielectric positioned in front of said microwave antenna structure so that microwaves transmitted or received by said microwave antenna structure pass through said dielectric, said dielectric having a dielectric constant of less than unity at microwave frequencies and a plasma frequency below that of said microwaves, said dielectric being effective to increase an apparent aperture of said microwave antenna structure.

4. The antenna arrangement of claim 3, wherein said dielectric includes a plurality of stacked planes of fine wires, the wires in a given plane being parallel to each other.

5. The antenna arrangement of claim 4, wherein each respective plane is arranged such that the fine wires in the respective plane are at right angles to the fine wires in adjacent planes.

6. The antenna arrangement of claim 4, wherein each plane of fine wires is supported by a sheet of polystyrene.

7. The antenna arrangement of claim 3, wherein the plasma frequency of said dielectric is below an operating frequency of said microwave antenna structure.

8. The antenna arrangement of claim 3, wherein said dielectric has fine wires coated with a non-linear magnetic material.

* * * * *